US008915226B2

(12) United States Patent
Yokoyama et al.

(10) Patent No.: US 8,915,226 B2
(45) Date of Patent: Dec. 23, 2014

(54) ELECTRODE MATERIAL FOR ELECTRODE OF SPARK PLUG

(75) Inventors: Taiji Yokoyama, Toyoake (JP); Toshihiro Uehara, Yasugi (JP)

(73) Assignees: Denso Corporation, Kariya (JP); Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 13/404,290

(22) Filed: Feb. 24, 2012

(65) Prior Publication Data

US 2012/0217433 A1 Aug. 30, 2012

(30) Foreign Application Priority Data

Feb. 25, 2011 (JP) ..... 2011-039192

(51) Int. Cl.
*H01T 13/20* (2006.01)
*H01T 13/39* (2006.01)

(52) U.S. Cl.
CPC ..... *H01T 13/39* (2013.01)
USPC ..... 123/169 EL; 420/441; 252/513

(58) Field of Classification Search
USPC ..... 420/441; 123/169 EL; 252/513
See application file for complete search history.

(56) References Cited

U.S. PATENT DOCUMENTS

| | | | | |
|---|---|---|---|---|
| 5,204,059 | A | 4/1993 | Sahira et al. | |
| 2010/0003163 | A1* | 1/2010 | Kloewer et al. | 420/443 |
| 2013/0078136 | A1* | 3/2013 | Hattendorf | 420/443 |

FOREIGN PATENT DOCUMENTS

| | | | |
|---|---|---|---|
| CN | 102947474 | | 2/2013 |
| DE | 102010024488 | * | 12/2011 |
| JP | S63-018033 | | 1/1988 |
| JP | H02-034734 | | 2/1990 |
| JP | H02-034735 | | 2/1990 |
| JP | H04-045239 | | 2/1992 |
| JP | H09-235637 | | 9/1997 |
| JP | 2006-316344 A | * | 11/2006 |
| JP | P2006-316344 A | | 11/2006 |

OTHER PUBLICATIONS

Chinese Official Action issued for Chinese Patent Application No. 201210048720.6 dated Apr. 25, 2013 with English translation.

* cited by examiner

*Primary Examiner* — Mark Kopec
*Assistant Examiner* — William Young
(74) *Attorney, Agent, or Firm* — Nixon & Vanderhye, P.C.

(57) ABSTRACT

An electrode material to be used for producing an earth electrode of a spark plug has a chemical composition of 0.3 to 3.0 mass % of Si, 0.01 to 0.3 mass % of one or more elements selected from the group consisting of Y and rare earth elements, not more than 0.5 mass % of Ti, not more than 1.2 mass % of Fe, and one or both of not more than 0.20 mass % of Ca and not more than 0.08 mass % of Mg. The electrode material further contains C, Mn, Cr, Al, N, S, a remainder Ni, and incidental impurities. In a total content of C, Mn, Cr, Al, N and S, C is not more than 0.1 mass %, Mn is less than 0.5 mass %, Cr is less than 0.5 mass %, Al is not more than 0.3 mass %, N is not more than 0.05 mass %, and S is not more than 0.03 mass %.

6 Claims, 4 Drawing Sheets

ELECTRODE MATERIAL FOR ELECTRODE OF SPARK PLUG

CROSS-REFERENCE TO RELATED APPLICATION

This application is related to and claims priority from Japanese Patent Application No. 2011-039192 filed on Feb. 25, 2011, the contents of which are hereby incorporated by reference.

BACKGROUND OF THE INVENTION

1. Field of the Invention

The present invention relates to electrode material to produce an electrode of a spark plug for internal combustion engines.

2. Description of the Related Art

In view of the recent trend of preventing global warming and is consumption of fossil fuel from increasing, the pollution control standards act and regulations to chemicals, particulate matter, or biological materials contained in exhaust gas emitted from internal combustion engines for motor vehicles become stricter year by year. In order to achieve this, because a combustion temperature of the internal combustion engine of a motor vehicle, etc. tends more to increase, a spark plug is more required to have a superior durability and long duration.

Various types of nickel base alloy (Ni base alloy) are widely used as an electrode material to be used for producing an electrode of a spark plug in view of oxidation resistance, spark wear resistance, high strength at elevated temperatures, etc. Recently, various types of spark plugs, other than the above spark plug having an electrode of Ni base alloy only, have been produced and used in order to be better protected against a high temperature environment. For example, a recent spark plug has an electrode having a double layer structure composed of a bottom part and a top part. The bottom part is made of Ni base alloy. The top part at which the spark is generated is made of noble metal in order to improve its lifetime. Another recent spark plug has an electrode made of Ni base alloy and a high conductive metal such as Ag and Cu as a core material of the electrode.

For example, it has been proposed that such a Ni base alloy is used as S the electrode material of a spark plug (for example, which is exposed to the inside of a combustion chamber of an internal combustion engine) contains approximately 3 mass % of Cr in view of obtaining easy workability, high oxidation resistance and high temperature strength.

It has also been proposed to use Ni base alloy which contains additive element in order to further improve the oxidation resistance. Specifically, the following conventional patent documents 1 to 5 have disclosed various electrodes of spark plugs in which one or more elements such, as Si, Mn and Al, or Y and rare earth elements are added into Ni base alloy. The Ni base alloy contains a low concentration of Cr which is added to obtain oxidation resistance.

Patent document 1: Japanese patent laid open publication No. S63-18033;

Patent document 2: Japanese patent laid open publication No. H02-34734;

Patent document 3: Japanese patent laid open publication H02-34735;

Patent document 4: Japanese patent laid open publication No. H04-45239; and

Patent document 5: Japanese patent laid open publication No. H09-235637.

Electrode material made of Ni base alloy which contains a relatively low concentration of Cr is an excellent material in view of workability. However, because alloy as the electrode material needs additive elements such as Si, Mn and Al (having an excellent oxidation resistance) instead of a decreased amount of Cr (having an effective oxidation resistance) and because a total amount of elements contained in the Ni base alloy is thereby increased, the electrode material of Ni base alloy tends to decrease the thermal conductivity and its melting point. That is, the more the amount of the additive elements is increased in order to increase the oxidation resistance capability, the more it is difficult to decrease the temperature of an electrode of the spark plug because of its low thermal conductivity, and the more it is easy to decrease the melting point of the electrode material forming an electrode of a spark plug and to cause spark wear of the electrode of the spark plug when the spark plug works.

By the recent trends of internal combustion engines to increase performance, combustion efficiency, and working load, the spark plug use-environment becomes further stricter. It becomes difficult for the conventional electrode material made of Ni base alloy containing a low concentration of Cr and additive elements to show sufficient characteristics.

Therefore, the inventors of this patent applied another conventional technique disclosed in patent document 6, Japanese patent laid open publication No. 2006-316344. The conventional technique disclosed in the patent document 6 provides a spark plug containing additives such as a small amount of Si, a decreased amount of Mn and Al, and a small amount of one or more kinds of rare earth elements or Y in order to have high thermal conductivity, high melting point, good oxidation resistance and high spark wear resistance.

However, there is still a demand or a room for improvement in view of oxidation resistance, workability and manufacturing cost of the electrode material to be used of producing an electrode of a spark plug disclosed in the conventional patent document 6.

SUMMARY

It is therefore desired to provide a novel electrode material, to be used for producing an electrode of a spark plug, with various superior properties such as a good spark wear resistance, a good oxidation resistance, easy workability and a low manufacturing cost.

To achieve the above purposes, the present exemplary embodiment discloses an electrode material to be used for producing an electrode of a spark plug. The electrode material consists essentially of: 0.3 to 3.0 mass % of Si, 0.01 to 0.3 mass % of one or more elements selected from the group consisting of Y and rare earth elements, not more than 0.5 mass % of Ti, not more than 1.2 mass % of Fe, and one or both of not more than 0.20 mass % of Ca and not more than 0.08 mass % of Mg. The electrode material further contains C, Mn, Cr, Al, N, and S. In a total content of C, Mn, Cr, Al, N and S in the electrode material, C is not more than 0.1 mass %, Mn is less than 0.5 mass %, Cr is less than 0.5 mass %, Al is not more than 0.3 mass %, N is not more than 0.05 mass %, and S is not more than 0.03 mass %. The electrode material further contains Ni as a main component of a remainder, and incidental impurities.

BRIEF DESCRIPTION OF THE DRAWINGS

A preferred, non-limiting embodiment of the present invention will be described by way of example with reference to the accompanying drawings, in which:

FIG. 3 is an enlarged view showing a cross section of the front part of the earth electrode in the spark plug along the line A-A shown in. FIG. 2;

DETAILED DESCRIPTION OP THE PREFERRED EMBODIMENTS

Figure 1:
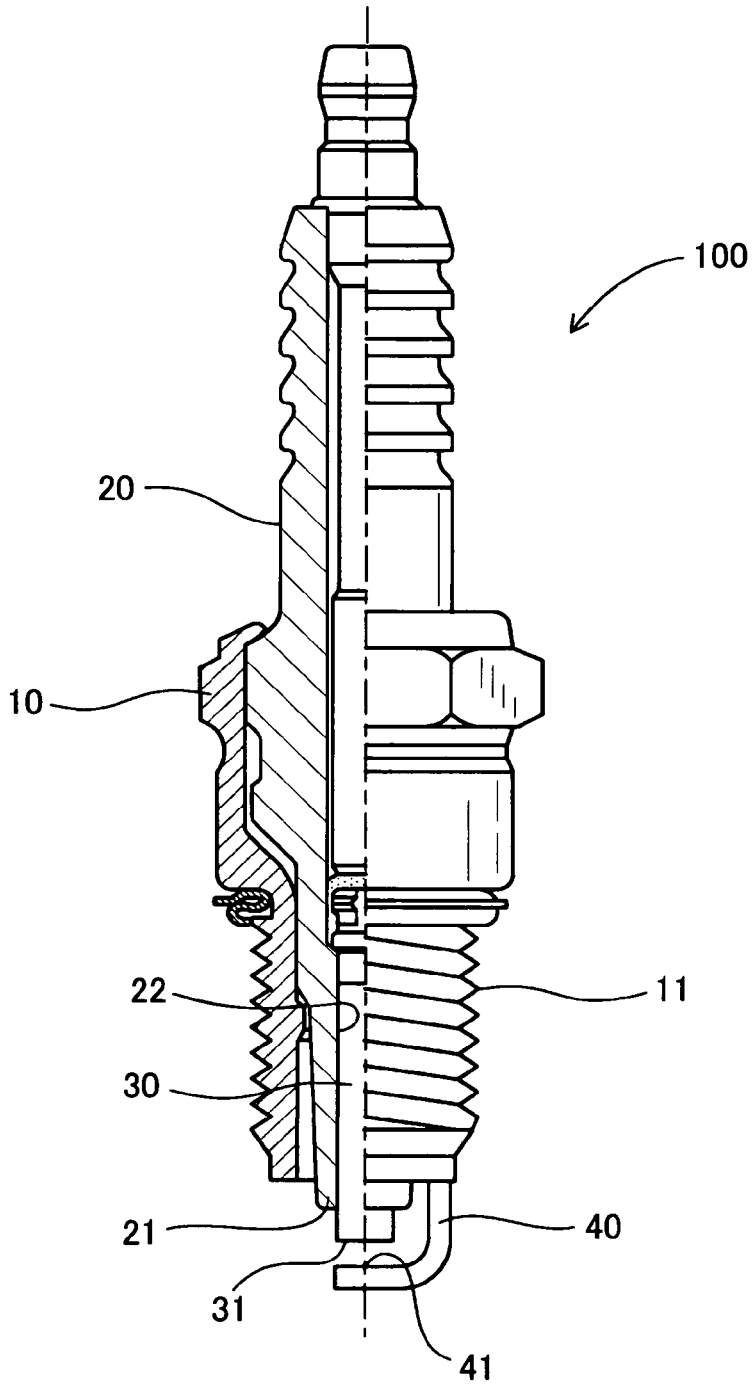
FIG. 1 is a view showing a partial cross section of an entire structure of a spark plug having a center electrode and an earth electrode made of an electrode material according to a first exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

First Exemplary Embodiment

A description will be given of an electrode material to be used for an electrode such as an earth electrode of a spark plug according to the first exemplary embodiment of the present invention with reference to FIG. 1 to FIG. 6.

The electrode material for an electrode of a spark plug according to the first exemplary embodiment consists of 0.3 to 3.0 mass % of Si, 0.01 to 0.3 mass % of one or more elements selected from the group consisting of Y and rare earth elements, not more than 0.5 mass % of Ti, not more than 1.2 mass % of Fe, and one or both of not more than 0.20 mass % of Ca and not more than 0.08 mass % of Mg. Further, the electrode material according to the first exemplary embodiment contains C, Mn, Cr, Al, N, and S. In the total content of C, Mn, Cr, Al, N, and S in the electrode material, C is not more than 0.1 mass %, Mn is less than 0.5 mass %, Cr is less than 0.5 mass %, AL is not more than 0.3 mass %, N is not more than 0.05 mass %, and S is not more than 0.03 mass %. The remaining electrode material according to the first exemplary embodiment consists of Ni. That is, Ni is a main element of the remainder. It is also acceptable for the electrode material according to the first exemplary embodiment to contain unavoidable impurities (or incidental impurities).

It is preferable for the electrode material of the spark plug to have a content of 0.031 to 0.5 mass % of Ti.

Further, it is preferable for the electrode material of the spark plug to have a thermal conductivity of not less than 40 W/m·K, and to have a melting point of not less than 1420° C.

A description will now be given of the spark plug 100 having a center electrode 30 and an earth electrode 40 with reference to FIG. 1 to FIG. 6.

In particular, the earth electrode 40 is made of the electrode material according to the first exemplary embodiment.

Figure 2:
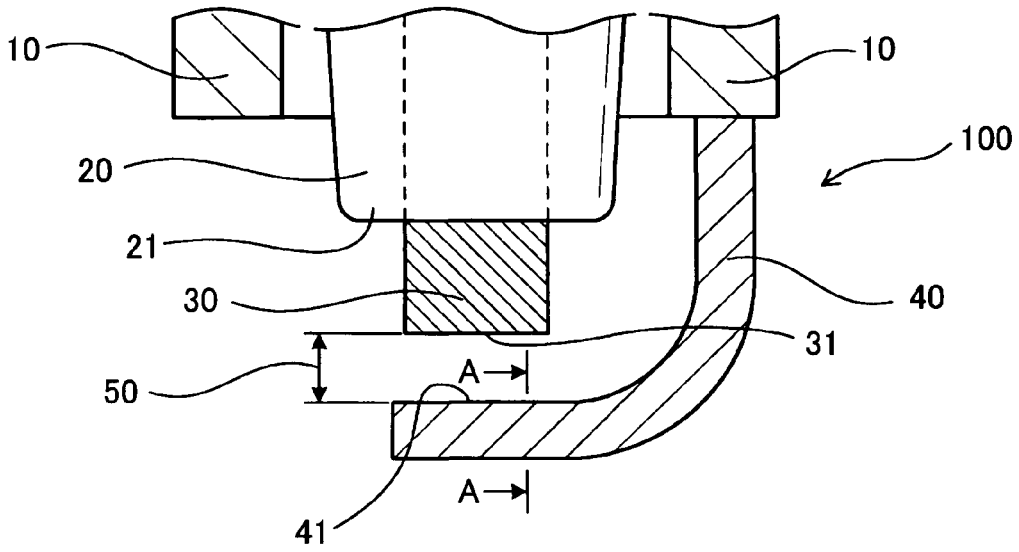
FIG. 2 is an enlarged view showing a cross section of a front part of the spark plug having the earth electrode made of the electrode material and the center electrode shown in FIG. 1.

FIG. 1 is a view showing a partial cross section of an entire structure of the spark plug 100 having the center electrode 30 and the earth electrode 40 made of the novel electrode material according to the first exemplary embodiment. FIG. 2 is an enlarged view showing a cross section of a front part of the spark plug 100 shown in FIG. 1.

The spark plug 100 is inserted into and fixed to a tapped hole formed in an engine block (not shown). The engine block forms a combustion chamber of an internal combustion engine.

The spark plug 100 has a mounting bracket 10 of a cylindrical shape made of conductive steel (for example, low carbon steel). The mounting bracket 10 has a mounting screw part 11 with which the spark plug 100 is screwed and fixed to the engine block. An insulator 20 is fixed to the inside of the mounting bracket 10. For example, the insulator 20 is made of alumina ceramics ($Al_2O_3$). The front part 21 of the insulator 20 is exposed to the outside from the mounting bracket 10.

Still further, the center electrode 30 is fixed to an axial hole 22 of the insulator 20. The center electrode 30 is supported and electrically insulated from the mounting bracket 10. The center electrode 30 has a cylindrical shape and is made of Ni alloy. As shown in FIG. 2, the front surface of the center electrode 30 is exposed to the outside atmosphere air from the front part 21 of the insulator 20.

As shown in FIG. 2, the earth electrode 40 is fixed to one end part of the mounting bracket 10 by welding. One part of the earth electrode 40 is bent in a character "L" shape so that the front surface 31 of the center electrode 30 faces one side surface 41 at the front end part of the earth electrode 40. As shown in FIG. 2, a spark discharging gap 50 is formed between the side surface 41 of the front end part of the earth electrode 40 and the front end part of the center electrode 30.

As previously described, the earth electrode 40 of the spark plug 100 is made of the electrode material according to the first exemplary embodiment.

The earth electrode 40 of the spark plug 100 has an ordinary size of an earth electrode in ordinary spark plugs to be used in motor vehicles.

Figure 3:
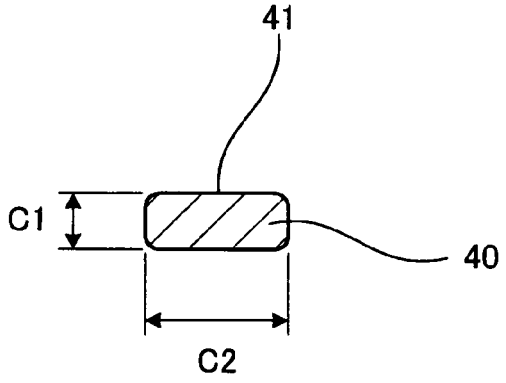

FIG. 3 is an enlarged view showing a cross section of the front end part of the earth electrode 40 in the spark plug 100 along the line A-A shown in FIG. 2.

As shown in FIG. 3, a cross section of the earth electrode 40 approximately has a rectangle shape. That is, the cross section of the earth electrode 40 is a rectangle plane. The cross sectional surface is perpendicular to an extending direction of the front end part of the earth electrode 40 at the front end part at which the side surface 41 of the earth electrode 40 faces the front surface 31 of the center electrode 30.

As shown in FIG. 3, a cross section at the front end part of the earth electrode 40 has a rectangle shape. In particular, a length C2 of one side of the cross section at front end part of the earth electrode 40 is longer than a length C1 of the other side in the cross section of the front end part of the earth electrode 40. One side surface 41 having the length C2 at the front end part of the earth electrode 40 faces the front surface 31 of the center electrode 30. Specifically, the length C1 of the other side has 1.6 mm and the length C2 of one side has 2.8 mm (C1=1.6 mm, and C2=2.8 mm).

Figure 4:
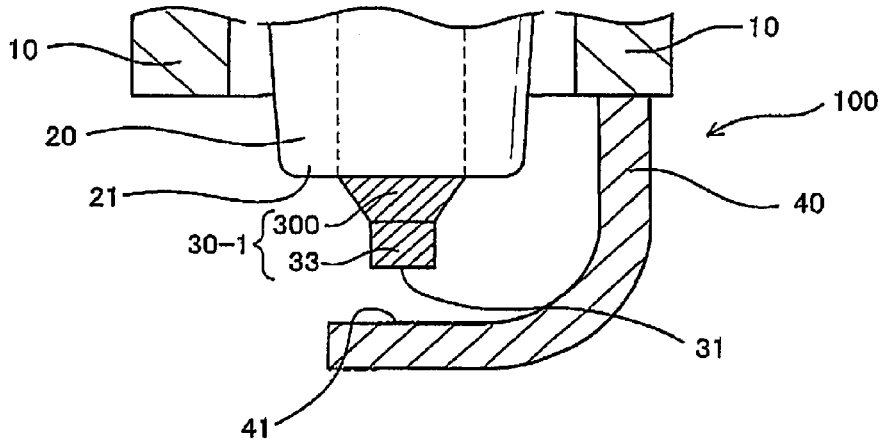
FIG. 4 is an enlarged view showing a cross section of the front part of the spark plug having the center electrode, which has a small-sized diameter part, and the earth electrode made of the electrode material according to the first exemplary embodiment of the present invention.

FIG. 4 is an enlarged view showing a cross section of other structure of the center electrode of the spark plug 100.

FIG. 4 is an enlarged view showing a cross section of the front part of the spark plug 100 having the center electrode 30, which has a small-sized diameter part, and the earth electrode 40 made of the electrode material according to the first exemplary embodiment of the present invention.

As shown in FIG. 4, it is possible for the spark plug 100 to have the center electrode 30-1 of a different structure. The front part 33 of the center electrode 30-1 has a diameter rather than a base part of the center electrode 30-1. For example, as shown in FIG. 4, it is possible for the center electrode 30-1 to have a tapered base part 300 and the front part 33 of a small diameter. The front part 33 has a cylindrical shape.

Figure 5:
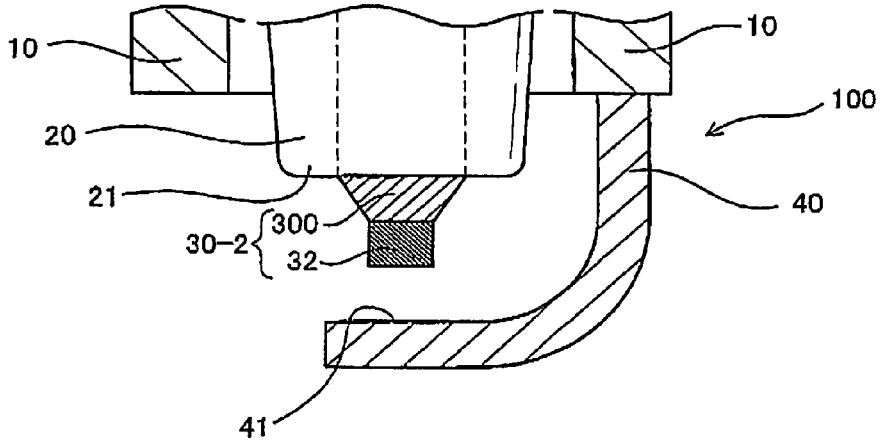
FIG. 5 is an enlarged view showing a cross section of another structure of the front part of the spark plug, in which the center electrode has a small sized diameter part and a noble metal alloy rod formed on the small sized diameter part, according to the first exemplary embodiment of the present invention.
Figure 6:
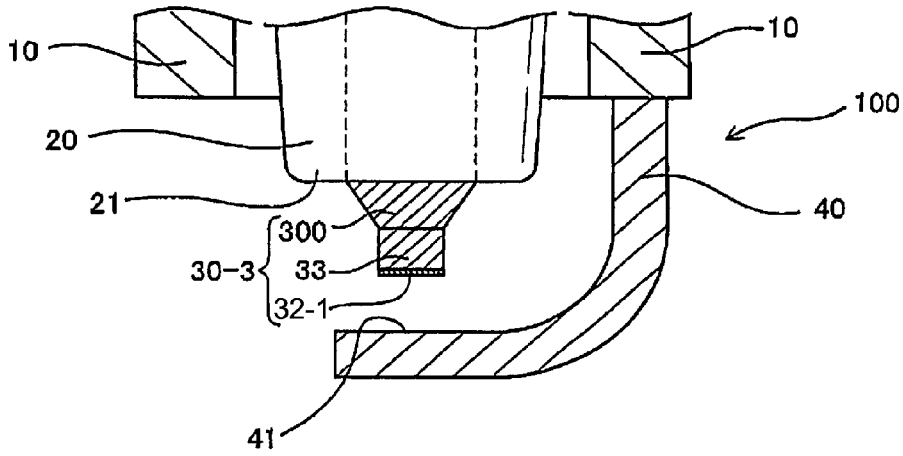
FIG. 6 is an enlarged view showing a cross section of another structure of the front part of the spark plug, in which the center electrode has a small sized diameter part and a thin noble metal alloy layer formed on the small sized diameter part, according to the first exemplary embodiment of the present invention.

FIG. 5 is an enlarged view showing a cross section of another structure of the front part of the spark plug 100. The center electrode 30-3 has a small sized diameter part 32. FIG. 6 is an enlarged view showing a cross section of another structure of the front part of the spark plug. The center electrode 30-3 as the small sized diameter part 33 and a thin noble metal alloy layer 32-1 formed on the small sized diameter part 33.

It is possible for the center electrode of the spark plug 100 to have a front part 32 made of an alloy having a superior wear and abrasion resistance such as a noble metal alloy (iridium alloy, platinum alloy). That is, as shown in FIG. 5, it is possible to join the front part 32 made of a noble metal alloy to the tapered base part 300 in order to form the center electrode 30-3.

Still further, as shown in FIG. 6, it is also possible to join the small sized diameter part 33 to the tapered base part 300, and to further join the thin part 32-1 made of a noble metal alloy. The thin part 32-1 made of the noble metal alloy has a thickness within a range of 0.1 to 0.5 mm.

(First Experiment)

A description will now be given of the experiment in order to evaluate various properties of electrode materials used in spark plugs according to the first exemplary embodiment. In the experiment, the electrode material to form the earth electrode has different chemical compositions.

Specimens 1 to 12 of the spark plug according to the first exemplary embodiment and comparative specimens 21 to 27 were used in this experiment. The specimens 1 to 12 and the comparative specimens 21 to 27 were made of material having different chemical compositions as shown in Table 1.

First, 10 kg alloy ingots were produced, each having a different chemical composition, by vacuum melting. After the process of executing a homogeneous annealing of the alloy ingot, a hot working was performed to produce a bar of 30 mm×30 mm cross section. During the process of making specimens, the experiment results show that no crack was generated in each of the specimens 1 to 12 having the chemical composition within the range disclosed in the first exemplary embodiment. The specimens 1 to 12 can be easily processed by cold working. It is possible for the specimens 1 to 12 having the chemical composition within the range disclosed in the first exemplary embodiment to have an excellent workability.

Table 1 shows various chemical compositions of the specimens 1 to 12 and the comparative specimens 21 to 27. A chemical composition of Ni and unavoidable impurities (or incidental impurities) is omitted from Table 1.

It is possible to add rare earth metal (REM) as a mixture of rare earth elements. In the experiment, La and Ce were added as an additive element. In particular, the symbol "<n (where n is a numerical value)" in Table 1 indicates a content of less than "n" which can be considered as without addition. Table 3 will also use the same expression.

TABLE 1

| Specimen No. | C | Si | Mn | Cr | Al | Ti | Y | REM | Fo | Mg | Ca | S | N |
|---|---|---|---|---|---|---|---|---|---|---|---|---|---|
| 1 | 0.003 | 1.01 | 0.04 | 0.04 | 0.035 | 0.015 | 0.15 | <0.01 | 0.05 | 0.0083 | 0.0001 | 0.0004 | 0.0005 |
| 2 | 0.008 | 1.02 | 0.05 | 0.07 | 0.038 | 0.031 | 0.14 | <0.01 | 0.03 | 0.0073 | 0.0002 | 0.0003 | 0.0006 |
| 3 | 0.006 | 1.01 | 0.05 | 0.05 | 0.027 | 0.053 | 0.1 | <0.01 | 0.03 | 0.0066 | 0.0001 | 0.0002 | 0.0007 |
| 4 | 0.009 | 1.04 | 0.07 | 0.03 | 0.045 | 0.083 | 0.13 | <0.01 | 0.04 | 0.0064 | 0.0001 | 0.0002 | 0.0004 |
| 5 | 0.007 | 0.97 | 0.06 | 0.06 | 0.059 | 0.104 | 0.11 | <0.01 | 0.03 | 0.0073 | 0.0001 | 0.0002 | 0.0006 |
| 6 | 0.005 | 1.08 | 0.05 | 0.04 | 0.041 | 0.23 | 0.16 | <0.01 | 0.03 | 0.0055 | 0.0002 | 0.0002 | 0.0006 |
| 7 | 0.005 | 0.96 | 0.04 | 0.08 | 0.044 | 0.5 | 0.14 | <0.01 | 0.04 | 0.0056 | 0.0001 | 0.0003 | 0.0005 |
| 8 | 0.002 | 1.03 | 0.08 | 0.07 | 0.029 | 0.041 | <0.001 | 0.07 | 0.05 | 0.0061 | 0.0001 | 0.0004 | 0.0006 |
| 9 | 0.003 | 2.14 | 0.09 | 0.06 | 0.041 | 0.064 | 0.09 | <0.01 | 0.04 | 0.0058 | 0.0002 | 0.0005 | 0.0008 |
| 10 | 0.004 | 1.29 | 0.05 | 0.04 | 0.016 | 0.073 | 0.06 | 0.06 | 0.03 | 0.0074 | 0.0001 | 0.0003 | 0.0005 |
| 11 | 0.051 | 1.05 | 0.07 | 0.04 | 0.043 | 0.231 | 0.158 | <0.01 | 0.31 | 0.08 | 0.151 | 0.0004 | 0.0431 |
| 12 | 0.062 | 1.05 | 0.05 | 0.04 | 0.037 | 0.234 | 0.321 | <0.01 | 1.08 | 0.072 | 0.002 | 0.0003 | 0.0007 |
| 21 | 0.006 | 1.17 | 0.09 | 0.08 | 0.048 | 1.16 | 0.11 | <0.01 | 0.03 | 0.0067 | 0.0002 | 0.0003 | 0.0007 |
| 22 | 0.004 | 1.31 | 1.76 | 1.53 | 0.06 | <0.001 | <0.001 | <0.01 | 0.31 | 0.007 | 0.0001 | 0.0008 | 0.0008 |
| 23 | 0.004 | 1.97 | 0.94 | 3.43 | 0.04 | 0.51 | <0.001 | <0.01 | 0.06 | 0.0056 | 0.0002 | 0.0006 | 0.0009 |
| 24 | 0.03 | 0.84 | 0.07 | 0.08 | 0.21 | 0.03 | <0.001 | <0.01 | <0.01 | <0.0001 | <0.0001 | <0.0001 | <0.0001 |
| 25 | 0.005 | 1.04 | 0.08 | 0.06 | 0.053 | 0.035 | 0.098 | <0.01 | 0.82 | 0.0088 | 0.002 | 0.0003 | 0.1187 |
| 26 | 0.009 | 1.03 | 0.06 | 0.08 | 0.033 | 0.041 | 0.514 | <0.01 | 0.47 | 0.079 | 0.003 | 0.0002 | 0.0082 |
| 27 | 0.078 | 1.04 | 0.07 | 0.5 | 0.038 | 0.033 | 0.088 | <0.01 | 1.52 | 0.065 | 0.001 | 0.0002 | 0.0007 |

Each of the specimens 1 to 12 shown in Table 1 uses an alloy as the electrode material to be used for producing the electrode material of the spark plug according to the first exemplary embodiment. On the other hand, each of the comparative specimens 21 to 27 uses an alloy as a conventional electrode material. The specimens 1 to 12 and the comparative specimens 21 to 27 were annealed at 800° C. for 1 hour. After this process, the specimens 1 to 12 and the comparative specimens 21 to 27 were tested.

Table 2 shows various properties of each of the specimens 1 to 12 and the comparative specimens 21 to 27:

hardness (HV);

thermal conductivity W/m·K;

melting point (° C.);

oxidation weight gain (mg/cm$^2$) in atmosphere air (800° C., 100 hours);

spalled scale (mg/cm$^2$) in atmosphere air (800° C., 100 hours);

oxidation weight gain (mg/cm$^2$) in an atmosphere air (900° C., 100 hours);

spalled scale (mg/cm$^2$) in atmosphere air (900° C., 100 hours);

oxidation weight gain (mg/cm$^2$) in atmosphere air (1000° C., 100 hours); and spalled scale (mg/cm$^2$) in atmosphere air (1000° C., 100 hours).

Hereinafter, "atmosphere air" means at a pressure of 1 atm.

As shown in Table 2, the oxidation resistance test was performed under three conditions, 800° C. and 100 hours, 900° C. and 100 hours, and 1000° C. and 100 hours.

In table 2, the thermal conductivity of each of the specimens 1 to 12 and the comparative specimens 21 to 27 was measured at 25° C. and 900° C.

However, the comparative specimen 21 containing a large amount of Ti had Ti which was not completely dissolved in the matrix, and has a thermal conductivity lower than 40W/(m·K). It can be considered that the comparative specimen 21 has no satisfied spark wear resistance.

Further, the specimens 1 to 12 of the alloy as the electrode material according to the first exemplary embodiment has a superior oxidation resistance because of containing not more than 0.05 mass % of N (nitrogen). That is, even if the alloy contains Ti capable of improving oxidation resistance in addition to Y and/or rare earth elements, it is difficult for the comparative specimen 25 to have an adequate oxidation resistance capability because it contains a large amount of N.

TABLE 2

| Specimen No. | Hardness (HV) after annealing | Thermal Conductivity (W/(m · K) 25° C. | Thermal Conductivity (W/(m · K) 900° C. | Melting point (° C.) | Atmosphere air (800° C. × 10 hours) Oxidation weight gain (mg/cm$^2$) | Atmosphere air (800° C. × 10 hours) Spalled scale (mg/cm$^2$) | Atmosphere air (900° C. × hours) Oxidation weight gain (mg/cm$^2$) | Atmosphere air (900° C. × hours) Spalled scale (mg/cm$^2$) | Atmosphere air (1000° C. × 10 hours) Oxidation weight gain (mg/cm$^2$) | Atmosphere air (1000° C. × 10 hours) Spalled scale (mg/cm$^2$) |
|---|---|---|---|---|---|---|---|---|---|---|
| 1 | 90 | 54.7 | 80.7 | 1429 | 2.3 | 0 | 6.5 | 0 | 12.6 | 0.3 |
| 2 | 89 | 55.9 | 75.4 | 1432 | 2.4 | 0 | 6.7 | 0 | 13.3 | 0.3 |
| 3 | 109 | 51.6 | 77.1 | 1437 | 2.5 | 0 | 6.3 | 0 | 12.9 | 0 |
| 4 | 90 | 53.3 | 73.6 | 1428 | 2.6 | 0 | 6.6 | 0 | 13.7 | 0 |
| 5 | 99 | 50.1 | 82.8 | 1437 | 2.7 | 0 | 6.3 | 0 | 13.2 | 0 |
| 6 | 95 | 48.3 | 76.3 | 1442 | 2.9 | 0 | 6.1 | 0 | 12.6 | 0 |
| 7 | 101 | 46.7 | 83.4 | 1431 | 2.9 | 0 | 6.1 | 0 | 12.4 | 0 |
| 8 | 97 | 53.4 | 75.9 | 1435 | 2.4 | 0 | 6.5 | 0 | 13.1 | 0 |
| 9 | 102 | 42.7 | 84.2 | 1408 | 2.2 | 0 | 6.1 | 0 | 9.2 | 0 |
| 10 | 98 | 52.5 | 75.3 | 1433 | 2.6 | 0 | 6.4 | 0 | 13.2 | 0 |
| 11 | 94 | 47.8 | 78.3 | 1422 | 2.6 | 0 | 6.2 | 0 | 12.4 | 0 |
| 12 | 108 | 51.4 | 77.8 | 1409 | 2.6 | 0 | 6.3 | 0 | 13.7 | 0.3 |
| 21 | 100 | 39.3 | 67.8 | 1419 | 3 | 0 | 6.3 | 0 | 12.3 | 0 |
| 22 | 134 | 24.9 | 53.3 | 1399 | 3.7 | 0 | 11.7 | 30.2 | 24.4 | 99.5 |
| 23 | 166 | 18.7 | 31.2 | 1385 | 0.1 | 0 | 0.5 | 0 | 2.3 | 0.1 |
| 24 | 99 | 56.1 | 67.9 | 1442 | 3.1 | 0 | 8.2 | 0 | 16.4 | 5.6 |
| 25 | 103 | 48.2 | 79.5 | 1420 | 2.8 | 0 | 6.6 | 0 | 15.2 | 3.2 |
| 26 | 103 | 48.9 | 81.2 | 1418 | 2.9 | 0 | 6.8 | 0 | 16.5 | 6.2 |
| 27 | 112 | 50.2 | 82.1 | 1415 | 3 | 0 | 6.4 | 0 | 18.3 | 5.3 |

Each of the specimens 1 to 12 of the alloy as the electrode material according to the first exemplary embodiment have high thermal conductivities at 25° C. and 900° C. which exceeds the value of 40 W/(m·K) and the value of 70 W/(m·K), respectively. Further, each of the specimens 1 to 12 has a high melting point of not less than 1400° C. Therefore the specimens 1 to 12 of the alloy as the electrode material according to the first exemplary embodiment have a superior spark wear resistance. In particular, each of the specimens 1 to 8, 11 and 12 containing a less amount of Si and Fe has a high melting point of not less than 1420° C. Therefore the specimens 1 to 8, 11 and 12 have a superior spark wear resistance.

On the other hand, the comparative specimens 22 and 23 containing a large amount of Mn and Cr has low thermal conductivity and a low melting point when compared with that of other specimens.

In particular, because the specimens 1 to 12 of the alloy according to the first exemplary embodiment contain Ti, there were almost no spalled scale when the oxidation resistance test was performed at 1000° C. Therefore the specimens 1 to 12 have an excellent oxidation resistance.

On the other hand, a large amount of spalled scale was observed in the comparative specimen 22 without Ti when the oxidation resistance test was performed at 1000° C. Further, a relatively large amount of spalled scale was observed in the comparative specimen 22 without Ti when the oxidation resistance test was performed at 900° C. The comparative specimen 22 has an increased oxidation weight gain after the oxidation resistance test.

The specimens 1 to 12 of the alloy as the electrode material according to the first exemplary embodiment have an easy cold workability because of having a Vickers hardness of less than 110 HV. On the other hand, the comparative specimen 27 has a high hardness because of containing a large amount of Fe.

Still further, the specimens 1 to 12 of the alloy as the electrode material according to the first exemplary embodiment have an excellent oxidation resistance because of having a low oxidation weight gain within a temperature range of 800° C. to 1000° C. In particular, the specimens 1 to 12 have a superior oxidation resistance because of almost having no spalled scale at 1000° C.

On the other hand, the comparative specimen 26 containing a large amount of Y and the comparative specimen containing a large amount of Fe had high oxidation weight gain and spoiled scale.

Furthermore, the comparative specimen 22, containing a large amount of Mn and Cr, but not containing any Y and rare earth element has a low thermal conductivity of less than 40 W/(m·K) at 25° C. and a low melting point which is drastically lower than 1420° C. Further, the comparative specimen 22 has a large amount of spalled scale. This means that a temperature rise easily occurred and oxidation is easily generated on the surface of the electrode of a spark plug when the comparative specimen 22 is used as the electrode material to produce an electrode of the spark plug.

Each of the elements C, Si, Mn, Cr, Al and Ti is used within a predetermined allowed value of the electrode material of the spark plug according to the first exemplary embodiment. Although the comparative specimen 24 not containing Y, Fe, Mg, Ca, S and N has a high thermal conductivity and a high melting point, spalled oxidation scale was generated at 1000° C. This means that the comparative specimen 24 has easy oxidation characteristics. If an electrode of a spark plug is produced by using electrode material without Fe, it is difficult to decrease the manufacturing cost.

As described above in detail, the electrode material, to be used for producing an electrode of a spark plug, according to the first exemplary embodiment has superior various properties such as a superior thermal conductivity, a superior oxidation resistance, a superior production cost, a superior spark wear resistance, and an easy workability.

Second Exemplary Embodiment

A description will be given of a second exemplary embodiment of the present invention. The second exemplary embodiment executed an engine bench test in order to detect an oxidation resistance and a spark wear resistance of the earth electrode 40 in each spark plug 100 having the structure according to the first exemplary embodiment shown in FIG. 1.

That is, the second exemplary embodiment prepares various types of spark plugs. Each of the spark plug has the earth electrode made of the alloy as each of the electrode materials as a specimen 31 and comparative specimens 41, 42 and 43. Table 3 shows the chemical composition of the alloy as each electrode material as each of the specimens 31 and the comparative specimens 41, 42 and 43. The engine bench test was executed for the spark plugs which used the specimen 31 and the comparative specimens 41, 42 and 43.

In the second exemplary embodiment, the alloy as the electrode material of each of the specimen 31 and the comparative specimens 41, 42 and 43 was used only to produce the earth electrode of the spark plug because the earth electrode 40 was more exposed to the inside of the combustion chamber of an internal combustion engine, as compared in position with the center electrode 30, during the second experiment. That is, because the earth electrode 40 has a higher temperature than the center electrode 30 during the fuel combustion, the earth electrode 40 is suitable for various resistance tests such as oxidation resistance test.

The specimen 31 shown in Table 3 was made of the alloy as the electrode material to produce the earth electrode 40 of the spark plug according to the first exemplary embodiment. On the other hand, each of the comparative specimens 41, 42 and 43 was made of a comparative alloy which is different in chemical composition from the electrode material according to the first exemplary embodiment.

TABLE 3

| Specimen No. | C | Si | Ma | Cr | Al | Ti | Y | REM | Fe | Mg | Ca | S | N |
|---|---|---|---|---|---|---|---|---|---|---|---|---|---|
| 31 | 0.007 | 0.97 | 0.06 | 0.06 | 0.059 | 0.104 | 0.11 | <0.01 | 0.03 | 0.0073 | 0.001 | 0.0002 | 0.0006 |
| 41 | 0.004 | 0.95 | 0.05 | 0.08 | 0.006 | <0.001 | 0.04 | <0.01 | <0.01 | <0.0001 | <0.0001 | <0.0001 | <0.0001 |
| 42 | <0.001 | 1.99 | 0.9 | 1.48 | <0.001 | <0.001 | 0.01 | <0.01 | <0.01 | <0.0001 | <0.0001 | <0.0001 | <0.0001 |
| 43 | <0.001 | 1.99 | 0.91 | 1.48 | <0.001 | <0.001 | 0.03 | <0.01 | <0.01 | <0.0001 | <0.0001 | <0.0001 | <0.0001 |

First, each spark plug having the earth electrode made of each of the specimens 31, 41, 42 and 43 was mounted to a 2.0 liter engine with four cylinders. The engine bench test was repeatedly executed by ten second full power at 5600 r/min, and 30 seconds idling in order to detect the durability of the earth electrode. The engine bench test promoted oxidation of the earth electrode of the spark plug. The state of oxidation after 150 hour durability test was detected by measuring a depth of oxidation formed on the surface of the earth electrode of the spark plug. Table 4 shows the evaluation results of the oxidation resistance test of each of the specimen 31 and the comparative specimens 41, 42 and 43.

TABLE 4

| Specimen No. | Depth of oxidation of earth electrode (dotocted after 150 hours) |
|---|---|
| 31 | 0.03 mm |
| 41 | 0.05 mm |
| 42 | 0.52 mm |
| 43 | 0.48 mm |

As can be understood from the evaluation results shown in Table 4, the specimen 31 has 0.03 mm depth of oxidation because of containing Ti and Y which are capable of increasing the oxidation resistance capability. The specimen 31 has a superior thermal conductivity because of containing a less amount of total alloy elements in Ni base alloy and of preventing a temperature rise at the earth electrode made of the specimen 31. Further, because the specimen 31 has a suitable amount of additive Ti and Y, this makes it possible to increase the oxidation resistance of the earth electrode made of the specimen 31.

On the other hand, the earth electrodes made of the comparative specimens 41, 42 and 42 had 0.05 mm, 0.52 mm, and 0.48 mm depth of oxidation, respectively. In particular, the earth electrodes made of the specimens 42 and 43 had a large depth of oxidation. In other words, oxidation drastically progressed in each of the earth plugs made of the specimens 42 and 43. This is because of a high temperature rise in the earth electrode made of each of the comparative specimens 42 and 43. That is, the comparative specimens 42 and 43 have a low thermal conductivity because of containing a rich amount of alloy elements in Ni base alloy.

Figure 7:
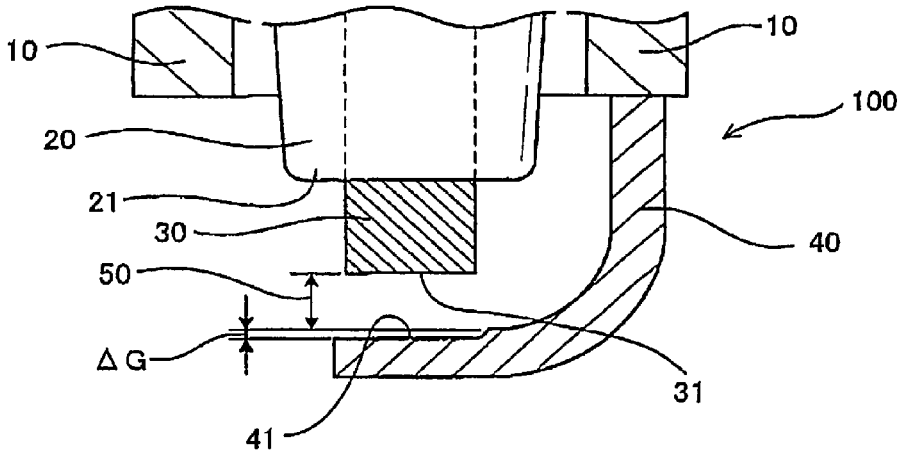
FIG. 7 is an enlarged view showing a cross section of the front part of the spark plug having the having the earth electrode and the center electrode in which the thickness of the earth electrode is decreased after durability test according to the second exemplary embodiment of the present invention.

Next, a description will now be given of other experimental results of the specimen 31 and the comparative specimens 41, 42 and 43 with reference to FIG. 7 and Table 5.

The spark plug having the earth electrode made of each of the specimen 31 and the comparative specimens 41, 42 and 43 was mounted to an inline four cylinder 2.0 L engine. The engine bench test was executed in order to detect a wear resistance against spark wear of the earth electrode of the spark plug. The engine bench test was executed under an actual drive pattern.

That is, the actual driving test was executed on the engine bench over 600 hours and an enlargement value ΔG of the spark discharge gap 50 at the earth electrode 40 side was detected. FIG. 7 shows an enlargement value ΔG of the spark discharge gap 50 at the earth electrode 40 side. As shown in FIG. 7, the spark discharge gap 50 indicates a gap between the center electrode 30 and the earth electrode 40 before the durability test. After the durability test, the spark discharge gap 50 is increased by the enlargement value ΔG. Table 5 shows the evaluation tests of the spark wear resistance of the earth electrode made of each of the specimen 31 and the comparative specimens 41, 42 and 43.

TABLE 5

| Specimen No. | Enlargement value (ΔG) of park discharge gap at earth electrode side |
|---|---|
| 31 | 0.08 mm |
| 41 | 0.10 mm |
| 42 | 0.24 mm |
| 43 | 0.25 mm |

As shown in Table 5, the earth electrode spark discharge gap 50 of specimen 31 has been enlarged by 0.08 mm.

On the other hand, the comparative specimens 41, 42 and 43 have a large increase in the spark discharge gap 50, namely, 0.10 mm, 0.24 mm, and 0.25 mm in enlargement gap ΔG, respectively because each of the specimens 41, 42 and 43 did not contain Ti and had a low oxidation resistance. The earth electrode 40 made of each of the specimens 41, 42 and 43 has a large wear by spark wear. Because the specimens 42 and 43 have a low melting point and a large amount of ware by spark because of containing a large amount of alloy elements in Ni base alloy.

The spark plug 100 having the earth electrode made of the electrode material as the specimen 31 according to the first exemplary embodiment has a low depth of oxidation and a small enlargement value ΔG of the spark discharge gap when compared with those of the earth electrode made of each of the specimens 41, 42 and 43. Accordingly, the electrode material according to the first exemplary embodiment has both the superior oxidation resistance and the superior spark wear resistance.

As previously described, the first exemplary embodiment shows the alloy as the electrode material having the improved and novel or unique chemical composition to be used for producing the earth electrode 40 of the spark plug 100.

Because the alloy as the electrode material according to the first exemplary embodiment has the superior thermal conductivity in addition to having the superior thermal resistance and the superior spark wear resistance, it is also possible to apply the electrode material disclosed in the first exemplary embodiment to the center electrode 30 of the spark plug 100. This also makes it possible to improve the wear resistance and the thermal resistance of the center electrode 30. That is, the electrode material according to the first exemplary embodiment can also be used for one or both the earth electrode and the center electrode of various types of spark plugs.

Features and Effects of the Electrode Material According to the Present Invention The inventors of the present invention have researched various chemical compositions of alloy as electrode material to be used for producing an electrode of a spark plug, where the spark plug starts to ignite the fuel combustion in an internal combustion engine. After the research of alloy as the electrode material, the inventors have discovered and recognized to be necessary to increase a thermal conductivity of the alloy as the electrode material. This increases and improves the oxidation resistance of the alloy as the electrode material.

It is further necessary to increase a melting point of the alloy as the electrode material in order to increase and improve the spark wear resistance of the alloy of the electrode material.

In order to satisfy the above requirements simultaneously, it is necessary to add a small amount of Si and to decrease a amount of Mn and Al, and to further add a small amount of one or more elements selected from the group consisting of Y and rare earth elements. Still further, it is necessary to add a small amount of Ti and to limit a content of N as impurity in order to obtain the effects of the addition of Ti.

Still further, the inventors of the present invention have discovered and recognized that adding a suitable amount of Mg or/and Ca, and Fe can improve the hot workability of producing the electrode of the spark plug and to reduce the manufacturing cost.

That is, the present invention provides the alloy as the novel electrode material, as previously described in the description of the exemplary embodiment in which the content of Mn, Cr, and Al is decreased to a low amount, and a small amount of Si and Ti is added, and a small amount of Y one or more elements selected from the group consisting of Y and rare earth elements is further added. This improved and unique chemical composition of the electrode material makes it possible to provide a high thermal conductivity and a high melting point, in other words, to prevent the thermal conductivity and the melting point from being decreased when compared with those of various conventional metal electrodes.

When an electrode such as an earth electrode of a spark plug is made of the electrode material according to the present invention, the thermal conductivity of the electrode is increased, and this makes it possible to decrease the temperature of the electrode of the spark plug when the spark plug works during a fuel combustion in an internal combustion engine. This also makes it possible to increase the oxidation resistance of the electrode of the spark plug.

Further, to prevent the melting point from being decreased makes it possible to prevent the spark wear resistance of the electrode of the spark plug from being decreased when the spark plug works during the fuel combustion.

In particular, Titanium Ti is an effective element to enhance the strength, ductility, and the intergranular oxidation resistance in a high temperature condition. Ti of not more than 0.5 mass % is inevitably added into the alloy as the electrode material. In addition to Ti, addition of one or more elements selected from the group consisting of Y and rare earth elements further increases and improves the oxidation resistance.

However, it may be difficult to improve the oxidation resistance even if the electrode material contains Ti. The inventors of the present invention have researched and discovered the presence of N as an impurity in the electrode material decreases the effect obtained by adding Ti. Because N and Ti make TiN, the presence of TiN decreases the oxidation resistance capability. In order to avoid this drawback, it is possible to increase the oxidation resistance when the amount of N is limited to not more than 0.05 mass %.

Further, the addition of a suitable amount of Mg and/or Ca and Fe to the alloy as the electrode material makes it possible to improve a hot workability to produce an electrode of a spark plug. This further makes it possible to decrease the manufacturing cost.

Still further, the limitation of the content of C, as low as possible, makes it possible to improve the workability of the electrode material during cold working.

Still further, the limitation of the content of S, as low as possible, makes it possible to suppress the decrease of the oxidation resistance, which is increased by adding Y and rare earth elements, and to improve the oxidation resistance capability of the electrode material. This further makes it possible to improve the workability when the electrode material is produced by hot working and to improve the ductility of the electrode material in a high temperature condition when a spark plug is produced.

The present invention provides the electrode material with the superior oxidation resistance, the superior spark wear resistance, and the superior workability and the low production cost.

As previously described in detail, one of the important features of the alloy as the electrode material according to the present invention is to contain a low content of Mn, Cr and Al, and to add a small amount of Si and Ti, and to further add a small amount of one or more elements selected from the group consisting of Y and rare earth elements. This makes it possible to prevent the thermal conductivity and the melting point from being decreased. That is, the novel chemical composition of the electrode material according to the present invention can increase the thermal conductivity and, on the other hand, decreases the use temperature of the electrode of a spark plug when the electrode of the spark plug is made of the electrode material. This makes it possible to improve the oxidation resistance of the electrode of the spark plug.

Further, because the alloy as the electrode material prevents melting point from being decreased, it is possible to prevent the spark wear of the electrode of the spark plug from being decreased when the spark plug works during the fuel combustion of an internal combustion engine.

A description will now be given of the reasons for the limitations and critical point in the content and amount of elements contained in the electrode material according to the present invention.

In general, a small amount of C provides easy workability. When an amount of C exceeds 0.1 mass %, the hardness of the electrode material after annealing is increased and the cold workability after annealing is decreased. It is therefore preferable for the electrode material to have not more than 0.1 mass % of C. A preferable range of C is not more than 0.05 mass %, and a more preferable range of C is less than 0.01 mass %. It is acceptable for the electrode material to have 0 mass % of C (without any addition level of C).

Si is an effective element capable of drastically increasing the oxidation resistance, but of decreasing the thermal conductivity and the melting point. Accordingly, in order to have an excellent oxidation resistance, Si is added into the alloy as the electrode material within a suitable range in order to prevent the thermal conductivity and the melting point from being decreased.

An amount of less than 0.3 mass % of Si does not show any improvement of the oxidation resistance. On the other hand, an amount of more than 0.3 mass % of Si decreases the melting point and the thermal conductivity of the electrode material. It is therefore preferable to add 0.3 to 3.0 mass % of Si in the electrode material. It is more preferable to add 0.5 to 1.5 mass % of Si in the electrode material.

Mn is an element capable of increasing the oxidation resistance, but of decreasing the thermal conductivity and the melting point. Like the composition of the alloy as the electrode material according the present invention, when the electrode material contains some amount of Si, it is necessary to decrease the amount of Mn in view of obtaining a high thermal conductivity and a high melting point. Since the melting point is largely decreased when the electrode material contains not less than 0.5 mass % of Mn, it is preferred to add less than 0.5 mass % of Mn to the electrode material. It is preferable to add not more than 0.2 mass % of Mn, and more preferable to add less than 0.1 mass % of Mn. Further, it is also acceptable for the electrode material to contain zero mass % of Mn (without any addition level of Mn).

Cr is an element capable of enhancing the oxidation resistance, but of decreasing the thermal conductivity and of deteriorating the workability.

When the alloy as the electrode material contains some amount of Si, it is necessary to decrease the amount of Cr in order to obtain the high thermal conductivity. Since the thermal conductivity is largely decreased when the electrode material contains not less than 0.5 mass % of Cr, it is preferable for the electrode material to contain less than 0.5 mass % of Cr.

Decreasing the capability of the oxidation resistance by containing less than 0.5 mass % of Cr can be adjusted or compensated by adding a small amount of Si and one or more elements selected from the group consisting of Y and rare earth elements. It is therefore preferable to add not more than 0.3 mass % of Cr to the electrode material, It is also acceptable for the electrode material to contain zero mass % of Cr (without any addition level of Cr).

Al is an element capable of enhancing the oxidation resistance, but of largely decreasing the thermal conductivity. Like the composition of the alloy as the electrode material according the present invention, when the electrode material contains some amount of Si, it is necessary to decrease the amount of Al in view of obtaining the high thermal conductivity.

Since the thermal conductivity is largely decreased when the electrode material contains more than 0.3 mass % of Al, it is preferable for the electrode material to contain not more than 0.3 mass % of Al. It is therefore preferable to add not more than 0.1 mass % of Al. It is also acceptable for the electrode material to contain zero mass % of Al (without any addition level of Al).

Y and rare earth elements are elements capable of increasing the oxidation resistance even if a small amount of those elements is added to the electrode material. In view of increasing the oxidation resistance capability, it is preferable for the electrode material to contain one or more elements selected from the group consisting of Y and rare earth elements in addition to adding the elements such as Si which also increases the capability of the oxidation resistance.

Rare earth elements (REM) are lanthanide elements such as La, Ce, Nd, Pr. When the electrode material contains less than 0.1 mass % of one or more lanthanide elements, the oxidation resistance is not adequately increased. Since the hot workability and weldability are decreased when the electrode material contains more than 0.3 mass % of REM. It is therefore preferable to add 0.01 to 0.3 mass % of one or more elements selected from the group consisting of Y and rare earth elements. However, it recommends having the upper limit in amount of Y and earth elements of not more than 0.2 mass %.

Ti is an essential element which acts as a grain-boundary strengthening element capable of increasing the strength, the ductility, and the intergranular oxidation resistance at high temperature. In particular, it is possible to further increase the oxidation resistance capability when the electrode material contains one or more elements selected from the group consisting of Y and rare earth elements. Exceeding 0.5 mass % of Ti causes decreasing the melting point and the thermal conductivity at room temperature, and this decreases the spark wear resistance. Accordingly, it is possible to add not more than 0.5 mass % of Ti to the electrode material. It is preferable to add Ti within the range of 0.001 to 0.5 mass %, and more preferable to add Ti within the range of 0.031 to 0.5 mass %. Further, it is most preferable to have the upper limit in content of Ti is 0.3 mass %. It is further preferable to add not more than 0.2 mass % of Ti to the electrode material. Still further, it is most preferable to add not less than 0.01 mass % of Ti to the electrode material. The range of not more than 0.5 mass % of Ti does not involve zero mass % because Ti is an essential element.

Ca and Mg are deoxidation and desulfurization elements capable of purifying the alloy of the electrode metal. This can improve the ductility of the electrode metal at a high temperature and promote the hot working. Therefore Ca and Mg are the essential elements to be added in the electrode material.

Mg is an element necessary to remove or fix S because Mg can be joined to S. However, an excess amount of Mg forms $Ni_2Mg$ at the grain boundary because Mg has a small solid solubility limit in Ni. Accordingly, eutectic reaction occurs in Ni and $Ni_2Mg$. Because this deteriorates the grain boundary when the electrode material is processed by hot working, this decreases the hot workability and the ductility at a high temperature. Accordingly, it is necessary to add not more than 0.05 mass % of Mg. It is preferable to add Mg within the range of 0.0001 to 0.05 mass % into the electrode material, and further to have a mass ratio of Mg/S of not less than 1 in order to remove or fix S without fail.

Ca is an element capable of bonding to S. Ca is therefore used in order to remove S, for example, from a solution. Accordingly, Ca is the effective element to remove S, instead of using Mg. However, because an excess amount of Ca decreases the hot workability, it is necessary to add not more than 0.20 mass % of Ca into the alloy of the electrode material. It is preferable to add Ca within a range of 0.0001 to 0.20 mass %.

It is possible to add one of Mg and Ca or both Mg and Ca into the alloy as the electrode material. When one of them is added, it is preferable to select Mg rather than Ca.

By the way, each of the definitions, "not more than 0.20 mass % of Ca", and "not more than 0.05 mass % of Mg", does not include zero mass %.

The definition, "one of or both of 0.20 mass % of Ca and 0.05 mass % of Mg", is a mandatory clause, i.e. of at least one of Ca and Mg is added.

In view of decreasing the manufacturing cost when the spark plug is produced by using the electrode material according to the present invention, it is possible to add 1.2 mass % of Fe as an upper limit value.

When more than 1.2 mass % of Fe is added, the oxidation resistance is decreased or deteriorated. It is therefore necessary to add not more than 1.2 mass % of Fe to the electrode material.

A bottom limit value of an adding amount of Fe is preferably 0.1 mass %. On the other hand, the upper limit value of the amount of Fe is preferably 0.6 mass %. The definition "not more than 1.2 mass % of Fe" does not involve zero mass % of Fe. That is Fe is an essential element to be added into the electrode material according to the present invention.

N and Ti are chemically bonded together to form TIN. Ti is an essential element to produce the electrode material. As previously described, Ti is an essential element which acts as a grain-boundary strengthening element capable of increasing the strength, the ductility, and the intergranular oxidation resistance at high temperature. Because N is an element to decrease the strength, the ductility, and the intergranular oxidation resistance at high temperature, the amount of N in the electrode material is limited to not more than 0.05 mass %. It is preferable to be limited to not more than 0.005 mass % of N into the electrode material.

S has a very small solid solubility limit in Ni, a small amount of S, rare earth element and Y are chemically bonded together to form sulfide. Rare earth element and Y are essential elements to increase the oxidation resistance capability. The formed sulfide decreases the effect of the oxidation resistance provided by rare earth element and Y.

In this case, because segregation of $Ni_3S_2$ occurs in a grain boundary, the eutectic reaction of Ni and $Ni_3S_2$ occurs in the grain boundary. Because a melting point of the eutectic area is extremely low, the presence of such eutectic area in the electrode material decreases the strength, the ductility, and the oxidation resistance within a temperature range of hot working. Accordingly, the presence of S decreases the strength of the grain boundary, and causes cracks during a hot working. In other words, S is an element to decrease the hot workability and the ductility at high temperature. Accordingly, it is necessary to be limited to not more than 0.03 mass % of S to the electrode material. It is more preferable to be limited to not more than 0.005 mass % of S to the electrode material.

Ni is an essential element in the remainder other than the elements previously described contained in the electrode material to be used for an electrode of a spark plug. It is acceptable for the electrode material to further contain unavoidable impurities (or incidental impurities).

There are P, Cu, O, etc. as unavoidable impurities (or incidental impurities). It is desirable to eliminate the presence of such unavoidable impurities from the electrode material as low as possible.

For example, it is acceptable to contain not more than 0.03 mass % of P, not more than 0.3 mass % of Cu, and not more than 0.01 mass % of O to the electrode material. Those ranges of P, Cu and O do not extremely affect the basic characteristics of the electrode material to be used of producing an electrode of a spark plug. It is more preferable to be limited to not more than 0.2 mass % of Cu into the electrode material.

Next, a description will now be given of the thermal conductivity and the melting start temperature.

In general, the thermal conductivity affects the decrease of a temperature of the electrodes of the spark plug after heated by fuel combustion. The thermal conductivity is an important factor to change the maximum temperature of the front part of an electrode of the spark plug during the fuel combustion in an internal combustion engine. Accordingly, it is desirable for the electrode material to have the thermal conductivity as high as possible. There is a tendency that the more the amount of alloy element is increased, the more the thermal conductivity of the electrode material is decreased. It is therefore necessary to decrease the total amount of alloy elements in order to obtain a high thermal conductivity. On the other hand, it is desirable to increase an adding amount of alloy elements in order to increase the oxidation resistance capability because the alloy elements can increase the oxidation resistance.

Because the melting point of the alloy as the electrode material is one of the important factors to affect the spark wear resistance of an electrode of a spark plug, it is desirable to increase the melting point of the electrode material. On the other hand, it is desirable to increase the total amount of alloy elements which have good effect to the oxidation resistance in order to improve the oxidation resistance of the electrode material.

It is desirable that the content of Ti in the electrode material is within a range of 0.031 to 0.5 mass %. This range makes it possible to prevent the melting point and the thermal conductivity at the room temperature from being decreased. This range further makes it possible to prevent the deterioration of the spark wear resistance. In particular, this range can provide a superior oxidation resistance to the electrode material.

Further, it is desirable that the thermal conductivity of the electrode material is not less than 40 W/(m·K) at the room temperature. Because this range can promote a heat exhaust discharged from the electrodes of a spark plug to outside, the oxidation resistance of the electrode material is increased.

Still further, it is desirable that the electrode material has the melting point of not less than 1420° C. This range makes it possible to enhance the spark wear resistance of the electrode of a spark plug effectively.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. An electrode material for an electrode of a spark plug, consisting essentially of:

0.3 to 3.0 mass % of Si, 0.01 to 0.3 mass % of one or more elements selected from the group consisting of Y and rare earth elements, Ti in an amount within a range of not less than 0.001 mass % and not more than 0.5 mass %, Fe in an amount within a range of more than 0.31 mass % and not more than 1.2 mass %, and at least one of Ca and Mg, the Ca being in an amount within a range of not less than 0.0001 mass % and not more than 0.20 mass % and the Mg being in an amount within a range of not less than 0.0001 mass % and not more than 0.08 mass %, and the electrode material further containing C, Mn, Cr, Al, N, and S, and in a total content of C, Mn, Cr, Al, N and S in a total electrode material composition, C being not more than 0.1 mass %, Mn being less than 0.5 mass %, Cr being less than 0.5 mass %, Al being not more than 0.3 mass %, N being not more than 0.05 mass %, and S being not more than 0.03 mass %, and the electrode material further containing Ni as a main part in a remainder and incidental impurities, a thermal conductivity of the electrode material is not less than 40 W/(m·K) at room temperature.

2. The electrode material according to claim 1, wherein the content of Ti is within a range of 0.031 to 0.5 mass %.

3. The electrode material according to claim 1, wherein the electrode material has a melting point of not less than 1420° C.

4. The electrode material according to claim 2, wherein the electrode material has a melting point of not less than 1420° C.

5. The electrode material according to claim 1, wherein a mass % ratio of Mg/S is not less than 1 (Mg/S >1).

6. The electrode material according to claim 1, wherein Cr is not more than 0.3 mass %.

* * * * *

UNITED STATES PATENT AND TRADEMARK OFFICE

CERTIFICATE OF CORRECTION

PATENT NO. : 8,915,226 B2
APPLICATION NO. : 13/404290
DATED : December 23, 2014
INVENTOR(S) : Yokoyama et al.

It is certified that error appears in the above-identified patent and that said Letters Patent is hereby corrected as shown below:

In the Specification,

The Specimen No. in Table 1 located on columns 5 and 6, line 28, “Fo” should read “Fe”

Signed and Sealed this
Ninth Day of June, 2015

Michelle K. Lee

Michelle K. Lee
*Director of the United States Patent and Trademark Office*